US009216581B2

(12) United States Patent
Cyman, Jr. et al.

(10) Patent No.: US 9,216,581 B2
(45) Date of Patent: Dec. 22, 2015

(54) APPARATUS AND METHOD FOR WIPING AN INKJET CARTRIDGE NOZZLE PLATE

(71) Applicant: R.R. DONNELLEY & SONS COMPANY, Chicago, IL (US)

(72) Inventors: Theodore F. Cyman, Jr., Grand Island, NY (US); Anthony V. Moscato, North Tonawanda, NY (US); Jeffrey M. Sabin, West Seneca, NY (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 14/175,619

(22) Filed: Feb. 7, 2014

(65) Prior Publication Data

US 2014/0225958 A1 Aug. 14, 2014

Related U.S. Application Data

(60) Provisional application No. 61/762,713, filed on Feb. 8, 2013.

(51) Int. Cl.
*B41J 2/165* (2006.01)

(52) U.S. Cl.
CPC ..... *B41J 2/16544* (2013.01); *B41J 2/16535* (2013.01); *B41J 2/16538* (2013.01)

(58) Field of Classification Search
CPC ..... B41J 2/16535
USPC ..... 347/33
See application file for complete search history.

(56) References Cited

U.S. PATENT DOCUMENTS

| | | | | |
|---|---|---|---|---|
| 5,087,805 | A | 2/1992 | Silverschotz et al. | |
| 5,126,752 | A | 6/1992 | Weinberg | |
| 5,126,766 | A | 6/1992 | Terasawa et al. | |
| 5,210,550 | A | 5/1993 | Fisher et al. | |
| 5,211,493 | A | 5/1993 | Stephenson et al. | |
| 5,369,429 | A | 11/1994 | Erickson | |
| 5,382,969 | A | 1/1995 | Mochizuki et al. | |
| 5,446,486 | A | 8/1995 | Reis | |
| 5,504,510 | A | 4/1996 | Miyakawa | |
| 5,512,924 | A | 4/1996 | Takada et al. | |
| 5,559,539 | A * | 9/1996 | Vo et al. | 347/33 |

(Continued)

FOREIGN PATENT DOCUMENTS

EP 0376345 7/1990

OTHER PUBLICATIONS

International Search Report and Written Opinion of International Application No. PCT/US2013/030047 dated Jul. 2, 2013, Applicants R.R. Donnelley & Sons Company (9 pages).

*Primary Examiner* — Manish S Shah
*Assistant Examiner* — Jeffrey C Morgan
(74) *Attorney, Agent, or Firm* — McCracken & Gillen LLC

(57) ABSTRACT

In a system and method for using a wiper to clean a nozzle plate of an inkjet head, a spring is disposed between the wiper and a mounting body, and the mounting body has a top portion and a bottom portion. The wiper is disposed proximate the top portion of the mounting body relative to the bottom portion of the mounting body. In addition, the wiper blade is transported across the face of a nozzle plate for wiping portions of the nozzle plate. A distance between the wiper blade and the bottom end of the mounting body is varied in accordance with variations in distances between the portions of the nozzle plate and the bottom portion of the mounting body.

19 Claims, 7 Drawing Sheets

(56) References Cited

U.S. PATENT DOCUMENTS

| | | | | |
|---|---|---|---|---|
| 5,631,676 | A | 5/1997 | Karz | |
| 5,751,327 | A | 5/1998 | De Cock et al. | |
| 5,793,389 | A | 8/1998 | Mitchell | |
| 5,825,380 | A | 10/1998 | Ichizawa et al. | |
| 5,877,788 | A | 3/1999 | Haan et al. | |
| 5,923,347 | A | 7/1999 | Wade | |
| 5,929,877 | A | 7/1999 | Hetzer et al. | |
| 5,929,878 | A | 7/1999 | Pelletier | |
| 5,992,990 | A | 11/1999 | Childers et al. | |
| 6,000,792 | A | 12/1999 | Koizumi et al. | |
| 6,030,074 | A | 2/2000 | Barinaga | |
| 6,089,693 | A | 7/2000 | Drake et al. | |
| 6,224,198 | B1 | 5/2001 | Cook et al. | |
| 6,273,103 | B1 | 8/2001 | Enz et al. | |
| 6,344,904 | B1 | 2/2002 | Mercer | |
| 6,357,854 | B1 | 3/2002 | Igval et al. | |
| 6,364,451 | B1 | 4/2002 | Silverbrook | |
| 6,402,293 | B1 | 6/2002 | Sawicki | |
| 6,435,637 | B1 | 8/2002 | Lyman | |
| 6,478,402 | B1 | 11/2002 | Greive | |
| 6,530,644 | B2 | 3/2003 | Premnath et al. | |
| 6,532,025 | B1 * | 3/2003 | Hiramatsu | 347/29 |
| 6,536,863 | B1 | 3/2003 | Beauchamp et al. | |
| 6,575,554 | B2 | 6/2003 | Yoshinaga | |
| 6,575,556 | B1 | 6/2003 | Eremity et al. | |
| 6,601,951 | B2 | 8/2003 | Kuwabara et al. | |
| 6,660,103 | B1 | 12/2003 | Johnston et al. | |
| 6,663,220 | B2 | 12/2003 | Suzuki et al. | |
| 6,669,327 | B1 | 12/2003 | Harper | |
| 6,679,590 | B2 | 1/2004 | Enz | |
| 6,733,106 | B1 | 5/2004 | Leemhuis | |
| 6,802,588 | B2 | 10/2004 | Garbacz et al. | |
| 6,808,246 | B2 | 10/2004 | Long | |
| 6,830,315 | B2 | 12/2004 | Silverbrook et al. | |
| 6,843,553 | B2 | 1/2005 | Ishii et al. | |
| 6,869,160 | B2 | 3/2005 | West et al. | |
| 6,880,912 | B2 | 4/2005 | Klausbruckner et al. | |
| 6,890,053 | B2 | 5/2005 | Myhill et al. | |
| 6,908,165 | B2 | 6/2005 | Pinard | |
| 6,991,311 | B2 | 1/2006 | Su et al. | |
| 7,070,250 | B2 | 7/2006 | Lester et al. | |
| 7,118,189 | B2 | 10/2006 | Kueseter et al. | |
| 7,212,319 | B2 | 5/2007 | Mercer | |
| 7,384,119 | B2 | 6/2008 | Karppinen et al. | |
| 7,401,888 | B2 | 7/2008 | Karppinen et al. | |
| 2004/0061736 | A1 | 4/2004 | Yun et al. | |
| 2004/0066428 | A1 | 4/2004 | West et al. | |
| 2005/0099469 | A1 | 5/2005 | Encrenaz et al. | |
| 2005/0219589 | A1 | 10/2005 | Mercer | |
| 2006/0181567 | A1 * | 8/2006 | Tezuka | 347/22 |
| 2008/0286021 | A1 * | 11/2008 | Asami | 399/351 |
| 2009/0244124 | A1 | 10/2009 | Kondo | |

* cited by examiner

APPARATUS AND METHOD FOR WIPING AN INKJET CARTRIDGE NOZZLE PLATE

CROSS-REFERENCE TO RELATED APPLICATION

The present application claims the benefit of Cyman, Jr. et al., U.S. Provisional Patent Application No. 61/762,713, filed on Feb. 8, 2013, and entitled "Apparatus and Method for Wiping an Inkjet Cartridge Nozzle Plate." The entire contents of such application are incorporated herein by reference.

BACKGROUND

1. Field of the Disclosure

The present disclosure relates generally to inkjet printing systems and more particularly to an apparatus and method for wiping a nozzle plate of an inkjet cartridge used in such printing systems.

2. Description of the Background of the Disclosure

High-speed printing systems typically include one or more imaging units. Each imaging unit has one or more inkjet cartridges and a controller controls each inkjet cartridge to eject a fluid (such as ink or other composition) onto a receiving surface. Each inkjet cartridge includes a nozzle plate that includes a plurality of orifices (nozzles) through which ink from inside the inkjet cartridge may be controllably ejected.

An inkjet cartridge typically includes a fluid chamber and one or more nozzles. Pressure inside of the fluid chamber is increased relative to ambient air pressure to force a drop of fluid through the nozzle(s). One type of inkjet cartridge uses a piezoelectric element that deforms a wall of the fluid chamber to reduce the volume thereof and thereby increase the pressure within the fluid chamber. Alternately, a heating element may be used to vaporize some of the fluid (or a constituent of the fluid such as a fluid carrier or a solvent) in the fluid chamber to form a bubble therein, which increases the pressure inside the fluid chamber. A controller controls the current that is passed through the piezoelectric element to control the deformation thereof or to control the current through the heating element in turn to control the temperature thereof so that drops are formed when needed. Other types of inkjet technologies known in the art may be used in the printing systems described herein.

In a printing system, an inkjet cartridge is secured to a carrier and disposed such that the nozzles of the inkjet cartridge are directed toward the receiving surface. The carrier may be manufactured from steel or other alloys that can be milled to a high precision. More than one inkjet cartridge may be secured to a carrier in this fashion in a one or two-dimensional array.

Dried ink, dust, paper fibers, and other debris can collect on a nozzle plate or in a nozzle of an inkjet cartridge and prevent proper ejection of ink from the nozzles thereof. The controller of a printing system can undertake periodic cleaning cycles during which ink is purged from the nozzle to release any debris in or near such nozzle. The purged ink and/or debris must be removed from the nozzle plate in the vicinity of the nozzles so that such purged ink and/or debris does not collect thereon and dry to create further debris that will later interfere with ejection of ink from nozzles of the cartridge.

SUMMARY

According to one aspect of the present disclosure, an apparatus to clean a nozzle plate of an inkjet head includes a wiper blade, a setscrew coupled to the wiper blade, a mounting body, a spring, a moveable member disposed in the body, a cavity, a fluid port, and a controller. The mounting body has a top portion and a bottom portion, the top portion being closer to the wiper blade than the bottom portion. The spring is disposed between the wiper blade and the bottom portion of the mounting body, and a portion of the spring is coupled to the wiper blade. The moveable member includes a threaded interior wall for receiving the setscrew and threading the setscrew to the threaded interior wall adjusts a compression load of the spring. Compression of the spring varies, thereby varying a distance between the wiper blade and the bottom portion of the mounting body, as the wiper blade is transported across a face of the nozzle plate to clean the nozzle plate. The fluid port is coupled to the cavity and fluid supplied through the fluid port urges the moveable member and the wiper blade toward the nozzle plate.

According to another aspect of the present disclosure, a method for using a wiper to clean a nozzle plate of an inkjet head includes the step of transporting the wiper blade across the face of a nozzle plate for wiping portions of the nozzle plate. A spring is disposed between the wiper blade and a mounting body, and a setscrew is coupled to the wiper blade, wherein a top portion of the mounting body is closer to the wiper blade than a bottom portion of the mounting body. The method includes the further steps of threading a portion of the setscrew to a threaded interior wall of moveable member disposed in the body to adjust a compression load of the spring, and supplying a fluid into a cavity of the mounting body to urge the moveable member and the wiper blade towards the nozzle plate. In addition, the method includes the step of varying a distance between the wiper blade and the bottom portion of the mounting body in accordance with variations in distances between the portions of the nozzle plate and the bottom portion of the mounting body.

DETAILED DESCRIPTION OF THE PREFERRED EMBODIMENTS

Figure 1:
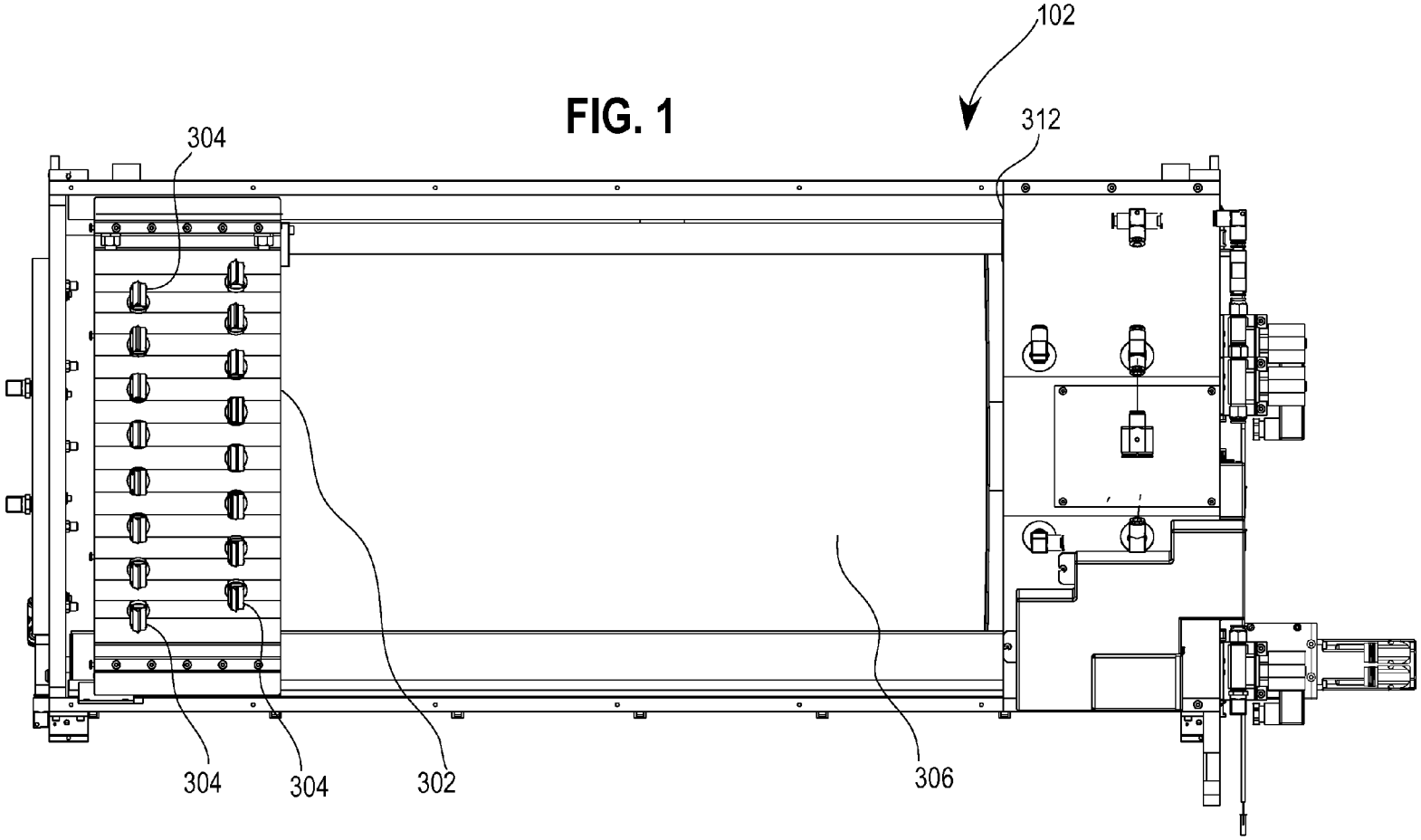
FIG. 1 is a plan view of a cleaning unit of a printing system.

Provisional U.S. Patent Application Ser. No. 61/685,002, filed Mar. 9, 2012, discloses a printing system that includes a printing unit and a cleaning unit, the entire contents of such application are incorporated herein by reference. The printing unit includes a carrier onto which a plurality of inkjet cartridges is disposed. Referring to FIG. 1, one embodiment of the cleaning unit 102 includes a wiper unit 302, a cleaning bay 306, and a wiper wash unit 312.

Figure 2:
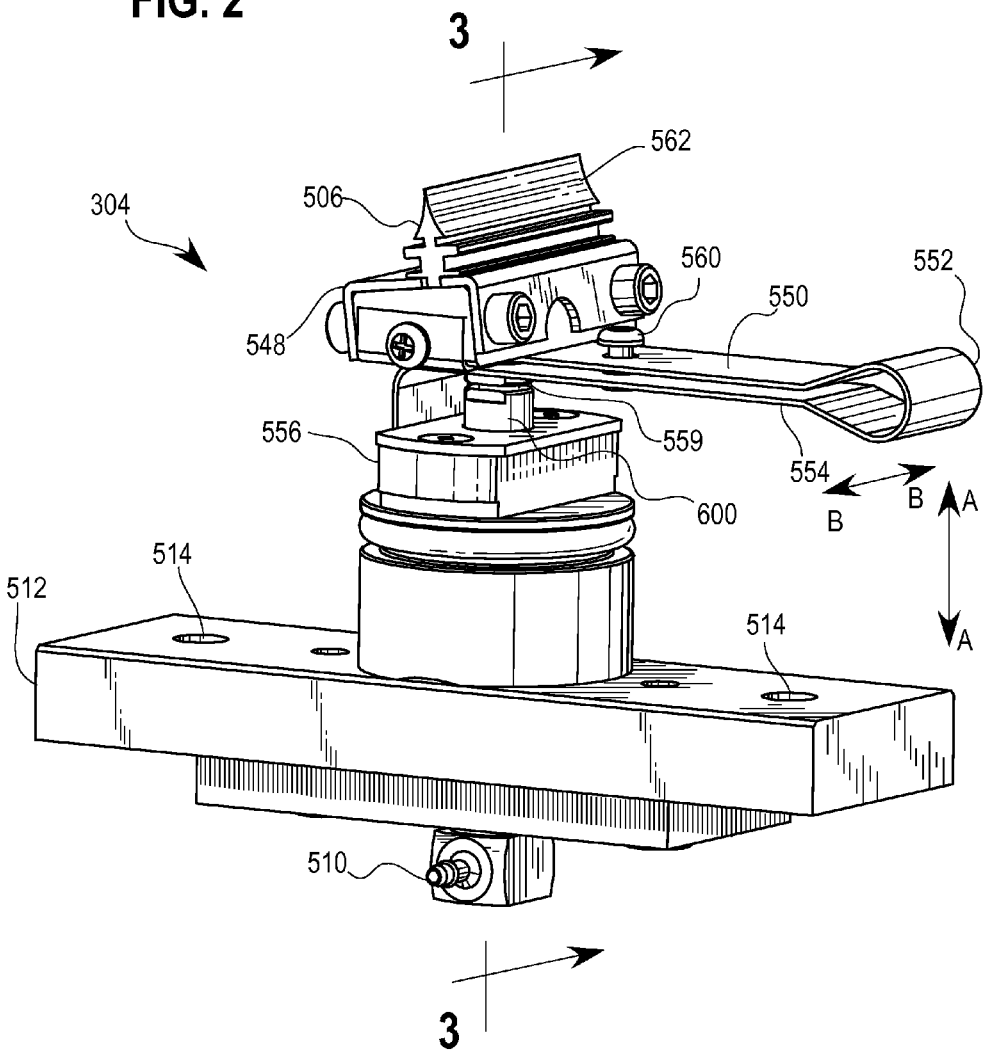
FIG. 2 is an isometric view of a wiper used in the cleaning unit of FIG. 1.

The wiper unit 302 includes a plurality of wipers 304 for wiping a nozzle plate of an inkjet cartridge. Some or all of the wipers 304 disclosed in the above-identified Provisional U.S. Patent Application Ser. No. 61/685,002 may be replaced by the wiper disclosed herein. Referring to FIG. 2 of the present application, one embodiment of a wiper 304 includes a wiper blade 506 extending outwardly from a mounting body 556. A mounting plate 512 disposed at a bottom end of the mounting body 556 includes screw holes 514 that are used to attach the mounting plate 512 (and therefore the wiper 304) to a mounting structure of the wiper unit 302. The wiper 304 also includes a port 510 that descends downwardly therefrom. Such port 510 may be connected to a fluid line through which a pressurized fluid, for example, air, may be supplied.

Figure 3A:
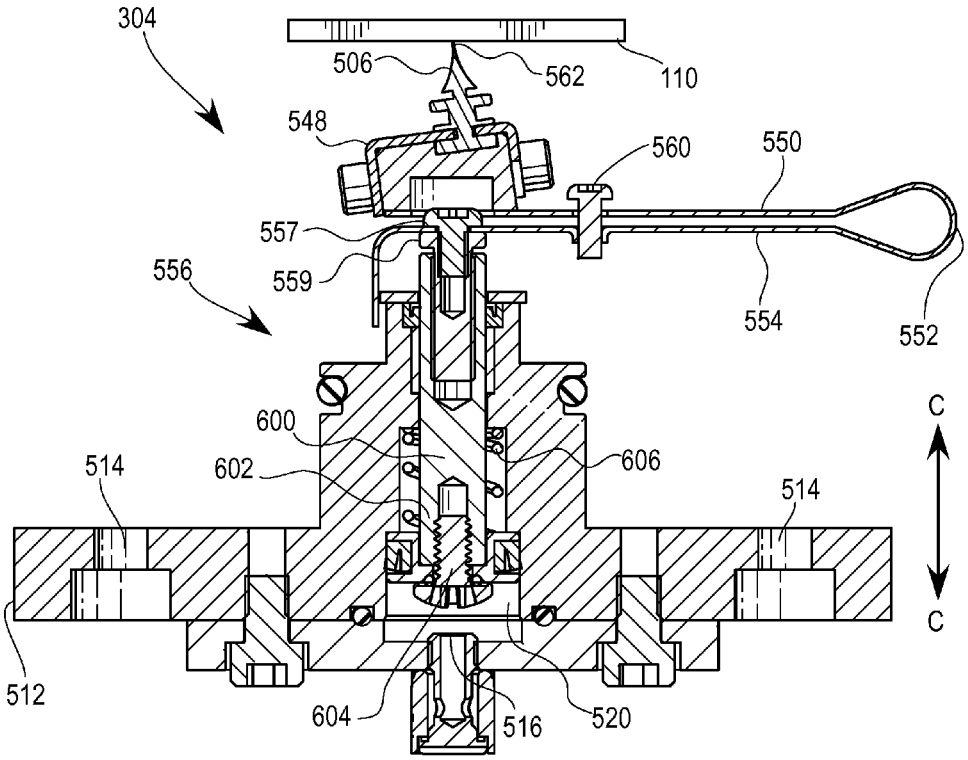
FIGS. 3A and 3B are a sectional views taken generally along the lines 3-3 of FIG. 2.

Referring to FIG. 3A, in one embodiment, the wiper blade 506 is attached to a wiper blade holder 548 and the wiper blade holder 548 is attached to a top bar 550 of a leaf spring 552. It should be apparent that the wiper blade 506 may be attached directly to the top bar 550 of the leaf spring 552. A bottom bar 554 of the leaf spring 552 is attached to a threaded shaft 557 of the wiper 304. In one embodiment, a bolt 557 secures the bottom bar 554 to the threaded shaft 559. The wiper blade holder 548 and the leaf spring 552 are disposed atop the mounting body 556.

Figure 3B:
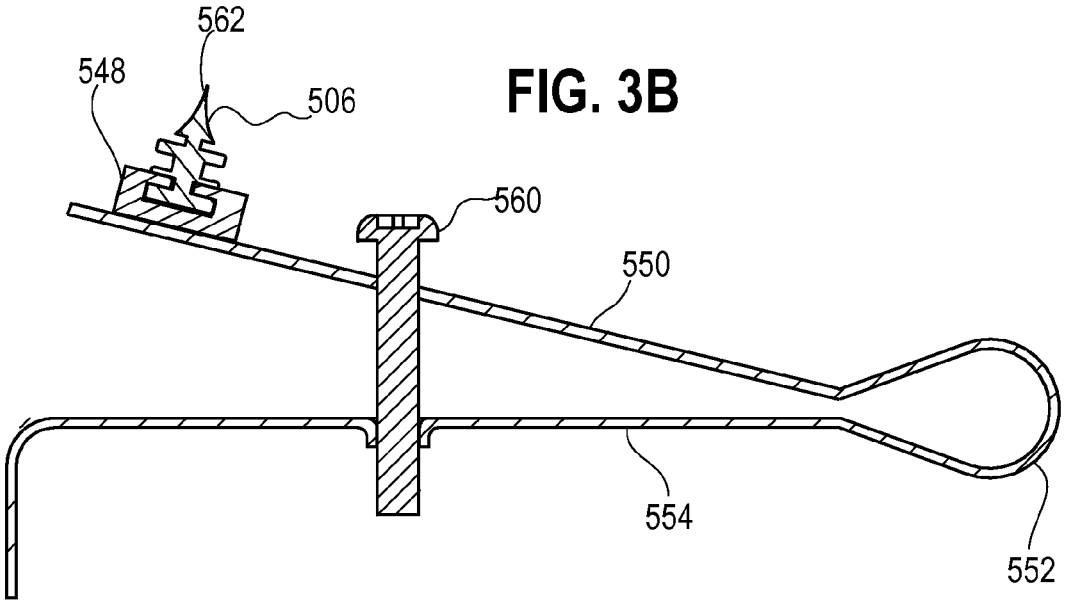

A bolt 560 couples the top bar 550 and the bottom bar 554 of the leaf spring 552. The bolt 560 is adjusted to pre-compress the leaf spring to limit travel thereof. Such pre-compression of the leaf spring prevents the wiper blade 506, the leaf spring 552, or any other component of the wiper unit 302 from contacting the nozzle plate 110 of the inkjet cartridge as the wiping unit 302 is when in a non-wiping positions. FIG. 3A shows the wiper 304 in a wiping position. As described further below, the wiper blade holder 548 has been urged upward until a wiper blade 506 is in contact with a nozzle plate 110. Sufficient pressure is applied by the wiper blade 506 to the nozzle plate 110 to compress the leaf spring 552 and thereby move the top bar 550 downwardly toward the bottom bar 554. FIG. 3B shows the wiper 304 when, for example, the wiping unit 302 in a non-wiping position. When the wiping unit 302 is in such non-wiping position, the cylinder 600 of the wiper 304 may be retracted downward toward the mounting 512. Because the wiper blade is not in contact with the nozzle plate 110, the leaf spring 552 is released and the top bar 550 is thereby moved upwardly away from the bottom bar 554. The bolt 560 is adjusted to establish a maximum distance the wiper blade 506 may be displaced by the leaf spring 552 in a direction parallel to a direction C-C. In one embodiment, the bolt 560 is adjusted to provide a maximum displacement of the wiper blade 506 of approximately 0.23 cm (0.09 inches).

Referring once again to FIGS. 2 and 3A, in some embodiments, the leaf spring 552 is manufactured from a material that allows the top bar 550 of the leaf spring 552 to exert torque about an axis B-B. In one embodiment, the material of the top bar 550 of the leaf spring 552 is selected so that such top bar 550 may exert up to between approximately 28.35 grams and approximately 70.9 grams (1.0 ounces and 2.5 ounces) of load due to torque about the axis B-B. In some embodiments, the leaf spring is manufactured from stainless steel. It should be apparent that other materials including, for example, another metal alloy, a metal, a plastic, or a polymer may be used to manufacture the leaf spring.

During operation, securing the wiper blade 506 of the wiper 304 to the leaf spring 552 allows the wiper blade 506 to adjust for variation in the distance between the bottom of nozzle plate 110 being wiped and the mounting plate 512. Such variation may occur, for example, if the nozzle plate 110 is not perfectly planar or if the plane of the nozzle plate 110 is not parallel to the plane of the mounting plate 512. The wiper blade 506 can also adjust for differences in the distances between the mounting plate 512 and the nozzle plates 110 of different inkjet cartridges wiped by the wiper blade 506. Other sources for such variation will be apparent to those having skill in the art.

Further, attaching the wiper blade 506 of the wiper 304 to the leaf spring 552 allows control over the force exerted by a nozzle plate 110 being wiped on the face 562 of the wiper blade 506 and how much the wiper blade 506 flexes in response to such force. Similarly, the use of the leaf spring 552 in this manner allows control over the wiping force exerted by the wiper blade 506 on the nozzle plate 110 and the amount and viscosity of fluid on the nozzle plate 110 that may be removed by the wiper blade 506. It should be apparent to those of skill in the art that such control can improve the effectiveness of wiping by the wiper blade 506, prevent damage to the wiper blade 506, and prevent damage to the nozzle plate 110 (e.g., because of excessive force applied thereto by the wiper blade 506).

Figure 4:
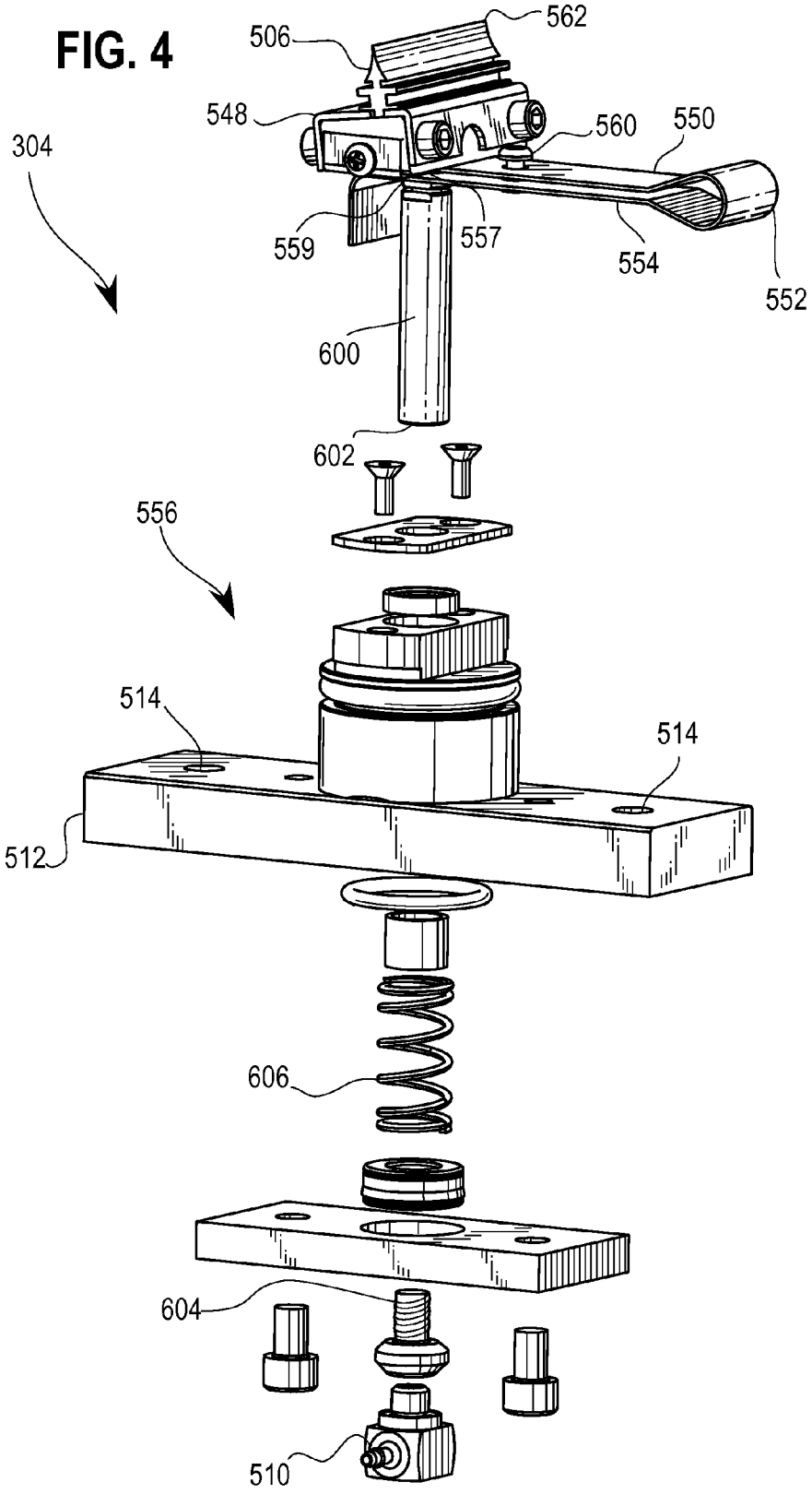
FIG. 4 is an exploded view of the wiper of FIG. 2.

Referring to FIGS. 3A, 3B, and 4, as noted above, the bolt 557 secures the bottom bar 554 of the leaf spring 552 to a top portion of the threaded shaft 559. The threaded shaft 559 is threaded to an interior portion of a cylinder 600. The cylinder 600 extends downwardly into an interior cavity 520 of the mounting body 556 of the wiper 304. A threaded portion 602 of the cylinder 600 screws into a bolt 604 that is disposed in the interior cavity 520 of the mounting body 556. An amount of the threaded shaft 559 that is screwed onto the cylinder 600 may be increased or decreased to adjust the distance between the bottom bar 554 and the mounting plate 512. Such an adjustment is typically undertaken before the wiper 304 is used to wipe the nozzle plate 110 of the inkjet cartridge to establish the resting position of the bottom bar 554 relative to the mounting plate 512. It should be apparent that adjusting such distance also adjusts the distance between the top portion 562 of the wiper blade 506 and the bottom of the nozzle plate 110 of an inkjet cartridge when the wiper 304 is not being used and is in a retracted position downward toward the mounting plate 512. In one embodiment, such distance is adjusted to be approximately 0.13 cm (0.05 inches).

The port 510 is coupled to an output port 516 that opens into the cavity 520. During operation of the wiper 304, pressurized fluid is supplied through the port 510 and exhausted via the port 516 into the cavity 520 of the mounting body 556. The pressurized fluid in the cavity 520 increases pressure within such cavity 520 and urges the cylinder 600 and the bolt 604, which act as a piston, to move upward in the direction C-C. Such movement of the cylinder 600 and the bolt 604 causes the leaf spring 552 and the wiper 304 secured thereto to rise. The upward movement of the cylinder 600 and the bolt 604 also compresses a spring 606 disposed in the interior of the wiper 304. A fluid controller (not shown) actuates a source of pressurized gas (not shown) to supply the pressurized fluid to the port 510 to lift the leaf spring 552 and the wiper blade 506 until the wiper blade 506 is at a predetermined distance from the mounting plate 512. The predetermined height is selected so that the wiper blade 506 at such distance contacts the nozzle plate 110 of an inkjet cartridge with a predetermined force. In one embodiment, such predetermined force is between approximately 28.35 grams and approximately 70.9 grams (1.0 ounce and 2.5 ounces). A motion controller (not shown) thereafter moves the wiper unit 302 and, therefore, the wiper blade 506 across the nozzle plate 110 of the inkjet cartridge to wipe ink and debris therefrom.

After the wiper 304 has wiped the nozzle plate 110, the controller causes the pressurized fluid to be released from the cavity 520 through the ports 516 and 510. It should be apparent to those having skill in the art that the controller may operate one or more valves and/or pumps to release the pressurized fluid from the cavity 520. Typically, the released fluid is exhausted to the environment or returned to the source of the gas. Releasing the fluid causes the spring 606 to decompress and thereby urge the cylinder 600 and the bolt 604 to move downward.

Figure 5A:
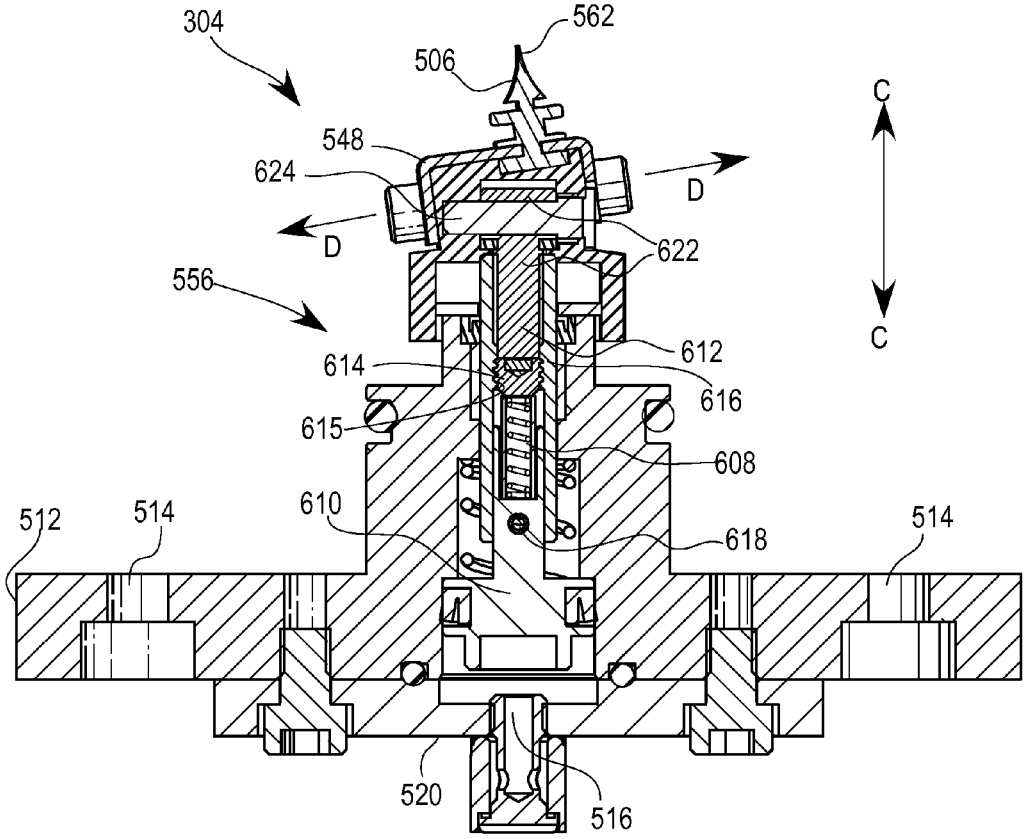
FIGS. 5A-5C are a sectional views of another wiper used in the cleaning unit of FIG. 1.
Figure 5B:
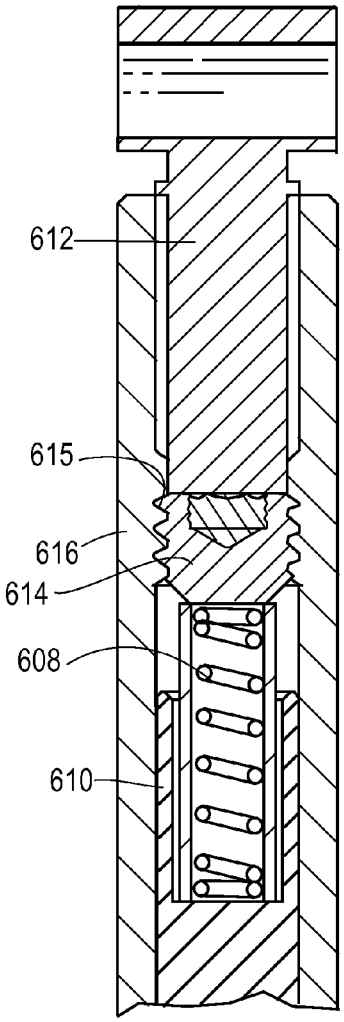
Figure 5C:
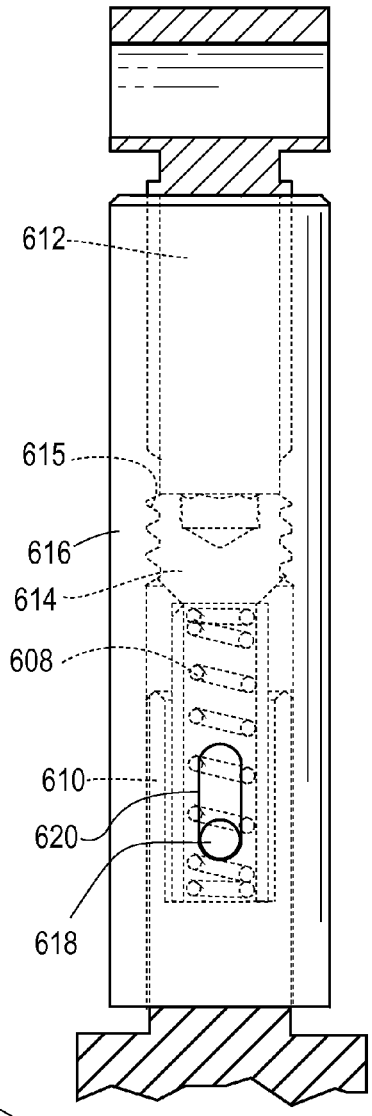

In some embodiments, a compression spring disposed inside the mounting body 556 of the wiper 304 may be used instead of the leaf spring 552 to allow the wiper blade 506 to compensate for variations in distance between nozzle plate 110 and the mounting plate 512. Referring to FIGS. 5A and 5B, an internal compression spring 608 is disposed between the wiper blade holder 548 and a piston 610. The wiper blade holder 548 is coupled to a shaft 612 and the shaft 612 is disposed in piston 610. A setscrew 614 extends from the shaft 612 and is threaded to an interior wall 615 of a cylinder 616 that surrounds both the piston 610 and the shaft 612. Threading the setscrew 614 in this manner sets the amount of compression load of the internal spring 608. Referring also to FIG. 5C, a pin 618 is affixed to the piston 610 and the cylinder 616 includes a slot 620. The cylinder 616 is disposed so that the pin 610 is positioned within the slot 620. The pin 618 and the slot 620 act together to limit the maximum upward and downward travel of the cylinder 616 and thereby the shaft 612 in the direction C-C. The pin 618 may also prevent rotation between the shaft 616 and the piston 610 about the axis F-F. The piston 610 may be urged upward and downward as described above and thereby lift or drop the cylinder 616, the compression spring 608, the shaft 612, and the wiper 506.

Figure 5D:
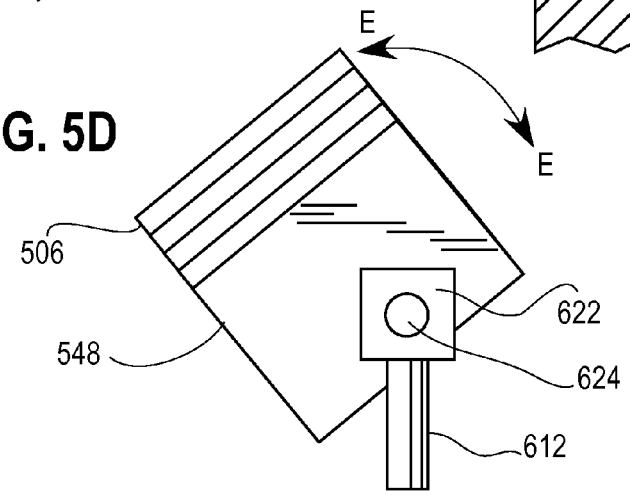
FIG. 5D is a plan view of a wiper holder of the wiper of FIGS. 5A-5C.

Referring to FIGS. 5A and 5D, in one embodiment, the wiper blade holder 548 is coupled to a shaft 622 by a pin 624. The shaft 622 is either integral to or secured to the shaft 612. The shaft 622 includes a bore through which the pin 624 is passed. In some embodiments, the pin 624 is adjusted to allow the wiper blade holder 548 to rotate about the axis of the pin 624 (i.e., in the direction E-E to further conform to variations in distance between the nozzle plate 110 and the mounting plate 512).

Other types external and/or internal springs may be used to support a wiper blade 506 such that the wiper blade 506 may accommodate variations in the orientation of nozzle plates 110 wiped thereby.

INDUSTRIAL APPLICABILITY

Numerous modifications to the present embodiments will be apparent to those skilled in the art in view of the foregoing description. Accordingly, this description is to be construed as illustrative only and is presented for the purpose of enabling those skilled in the art to make and use the embodiments and to teach the best mode of carrying out same.

What is claimed is:

1. An apparatus to clean a nozzle plate of an inkjet head, comprising:

a wiper blade;

a setscrew coupled to the wiper blade;

a mounting body having a top portion and a bottom portion, the top portion being closer to the wiper blade than the bottom portion;

a spring disposed between the wiper blade and the bottom portion of the mounting body, wherein a portion of the spring is coupled to the wiper blade;

a moveable member disposed in the body, wherein the moveable member includes a threaded interior wall for receiving the setscrew, and threading the setscrew to the threaded interior wall adjusts a compression load of the spring;

a cavity in the mounting body; and a fluid port coupled to the cavity;

wherein the compression of the spring varies, thereby varying a distance between the wiper blade and the bottom portion of the mounting body, as the wiper blade is transported across a face of the nozzle plate to clean the nozzle plate, and wherein a fluid supplied through the fluid port urges the moveable member and the wiper blade toward the nozzle plate.

2. The apparatus of claim 1, wherein the spring comprises a leaf spring disposed between the wiper blade and the mounting body.

3. The apparatus of claim 1, wherein the spring is disposed within the mounting body, and threading the setscrew sets the compression load of the spring.

4. The apparatus of claim 1, wherein a further portion of the spring is coupled to a piston disposed in the cavity in the mounting body.

5. The apparatus of claim 1, wherein releasing fluid from the cavity of the mounting body urges the wiper blade away from the nozzle plate.

6. The apparatus of claim 1, wherein a piston is disposed in the mounting body and the wiper blade is rotatable about an axis perpendicular to a central axis of the piston.

7. The apparatus of claim 1, further comprising a wiper blade holder, and a shaft coupled to the wiper blade holder, wherein the wiper blade is disposed on the wiper blade holder and the setscrew extends from the shaft.

8. The apparatus of claim 7, further comprising a piston disposed in the mounting body, wherein the moveable member surrounds the shaft and the piston.

9. The apparatus of claim 8, wherein the spring is disposed between the shaft and the piston.

10. The apparatus of claim 8, wherein the fluid urges the piston upward.

11. A method for using a wiper to clean a nozzle plate of an inkjet head, wherein a spring is disposed between a wiper blade and a mounting body, and a setscrew is coupled to the wiper blade, the mounting body having a top portion and a bottom portion, the top portion being closer to the wiper blade than the bottom portion, the method comprising:

threading a portion of the setscrew to a threaded interior wall of a moveable member disposed in the body to adjust a compression load of the spring;

supplying a fluid into a cavity of the mounting body to urge the moveable member and the wiper blade towards the nozzle plate;

transporting the wiper blade across the face of a nozzle plate for wiping portions of the nozzle plate; and varying a distance between the wiper blade and the bottom portion of the mounting body in accordance with variations in distances between the portions of the nozzle plate and the bottom portion of the mounting body.

12. The method of claim 11, further including the step of varying compression of a spring between the wiper blade and the mounting body in accordance with a distance between a portion of the nozzle plate and the bottom portion of the mounting body.

13. The method of claim 12, wherein the spring comprises a leaf spring.

14. The method of claim 12, wherein the spring comprises a compression spring disposed in the mounting body.

15. The method of claim 11, further including the step of releasing the fluid from the cavity of the mounting body to move the wiper blade away from the nozzle plate.

16. The method of claim 11, wherein a piston is disposed in the mounting body, further including the step of rotating the wiper blade about an axis perpendicular to a central axis of the piston.

17. The method of claim 11, including the further steps of disposing the wiper blade on a wiper blade holder, and coupling a shaft to the wiper blade holder, wherein the set screw extends from the shaft.

18. The method of claim 17, including the further steps of disposing a piston in the mounting body such that the moveable member surrounds the shaft and the piston.

19. The method of claim 18, wherein supplying the fluid comprises urging the piston toward the nozzle plate.

* * * * *